US006660441B2

(12) United States Patent
Yu

(10) Patent No.: US 6,660,441 B2
(45) Date of Patent: Dec. 9, 2003

(54) SIMPLIFIED FLEXIBLE ELECTROSTATOGRAPHIC IMAGING MEMBER BELT

(75) Inventor: Robert C. U. Yu, Webster, NY (US)

(73) Assignee: Xerox Corporation, Stamford, CT (US)

( * ) Notice: Subject to any disclaimer, the term of this patent is extended or adjusted under 35 U.S.C. 154(b) by 41 days.

(21) Appl. No.: 10/037,858

(22) Filed: Jan. 7, 2002

(65) Prior Publication Data

US 2003/0134210 A1 Jul. 17, 2003

(51) Int. Cl.[7] ..... G03G 5/047
(52) U.S. Cl. ..... 430/58.05
(58) Field of Search ..... 430/58.05

(56) References Cited

U.S. PATENT DOCUMENTS

| | | | | |
|---|---|---|---|---|
| 4,983,481 A | | 1/1991 | Yu | 430/59 |
| 5,089,369 A | | 2/1992 | Yu | 430/96 |
| 5,167,987 A | | 12/1992 | Yu | 427/171 |
| 5,187,496 A | * | 2/1993 | Yu | 346/135.1 |
| 5,256,509 A | * | 10/1993 | Hayashi et al. | 430/58.05 |
| 5,262,260 A | * | 11/1993 | Yokoyama et al. | 430/58.05 |

* cited by examiner

*Primary Examiner*—Mark A. Chapman
(74) *Attorney, Agent, or Firm*—R. Thompson; E. D. Palazzo

(57) ABSTRACT

An electrostatographic imaging member having a substrate support material which eliminates the need for an anticurl backing layer, a substrate support layer and a charge transport layer having a thermal contraction coefficient difference in the range of from $-2\times10^{-5}/°$ C. to about $+2\times10^{-5}/°$ C. a substrate support material having a Glass Transition Temperature (Tg) of at least 100° C., wherein the substrate support material is not susceptible to attack from the charge transport layer coating solution solvent and wherein the substrate support material is represented by the two structural formulas below:

(I)

(II)

-continued
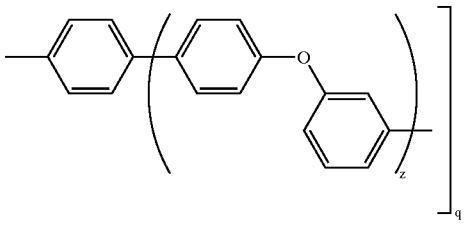
wherein m, n, and q represent the degree of polymerization having a number from 10 to 300; and x, y, and z are integers; with x and y from 2 to 10 and z from 1 to 10. An electrostatographic imaging member containing this substrate support layer.
33 Claims, 3 Drawing Sheets

SIMPLIFIED FLEXIBLE ELECTROSTATOGRAPHIC IMAGING MEMBER BELT

BACKGROUND OF INFORMATION

1. Field of the Invention

The present invention relates to imaging members and to the preparation of a structurally simplified imaging member which does not exhibit curling of the multilayered imaging member webstock after coating and drying of the charge transport layer.

An advantage of the present invention is to provide improved methodology for fabricating multiple layered imaging member webstocks which overcomes curling of the multiple layers.

The present invention provides an improved process for imaging member webstock fabrication having a simplified material configuration.

2. Description of Related Art

Electrostatographic flexible imaging members are well known in the art. Typical flexible electrostatographic imaging members include, for example, (1) photosensitive members (photoreceptors) commonly utilized in electrophotographic processes and (2) electroreceptors such as ionographic imaging members for electrographic imaging systems. The flexible electrostatographic imaging members may be seamless or seamed belts. Electrophotographic imaging member belts comprise a charge transport layer and a charge generating layer on one side of a supporting substrate layer and an anticurl backing layer coated on the opposite side of the substrate layer. Some electrographic imaging member belts have a more simple material structure comprising a dielectric imaging layer on one side of a supporting substrate and an anticurl backing layer on the opposite side of the substrate.

Electrophotographic flexible imaging members may comprise a photoconductive layer comprising a single layer or composite layers. Typical electrophotographic imaging members exhibit undesirable imaging member curling and require an anticurl backing layer. The anticurl backing layer is provided to prevent the multiple layers of an imaging member from curling and thereby keeping the member flat. One type of composite photoconductive layer used in electrophotography is illustrated in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and the conductive layer, the outer surface of the charge transport layer is charged with a uniform charge of a negative polarity and the supporting electrode is utilized as an anode. The supporting electrode may still function as an anode when the charge transport layer is sandwiched between the supporting electrode and the photoconductive layer. The charge transport layer in this latter embodiment is capable of supporting the injection of photogenerated electrons from the photoconductive layer and transporting the electrons through the charge transport layer. Photosensitive members having at least two electrically operative layers, as discussed above, provide excellent electrostatic latent images when charged with a uniform negative electrostatic charge, exposed to a light image and thereafter developed with finely divided electroscopic marking particles. The resulting image is transferable to a receiving member such as paper.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For flexible electrophotographic imaging members having a belt configuration, the numerous layers found in modern photoconductive imaging members are highly flexible, adhere well to adjacent layers, and exhibit predictable electrical characteristics within narrow operating limits to provide excellent toner images over many thousands of cycles. One type of multilayered photoreceptor that has been employed as a belt in negatively charging electrophotographic imaging systems consists of a substrate, a conductive layer, a blocking layer, an adhesive layer, a charge generating layer, a charge transport layer, and a conductive ground strip layer adjacent to one edge of the imaging layers. This photoreceptor belt may also comprise an additional layer such as an anticurl backing layer to achieve the desired imaging member belt flatness.

In a service environment, a flexible imaging member belt, mounted on a belt supporting module, is exposed to repetitive electrophotographic image cycling which subjects the outer-most charge transport layer to mechanical fatigue as the imaging member belt bends and flexes over the belt drive roller and all other belt module support rollers, as well as sliding bend contact above each backer bar's curving surface. This repetitive imaging member belt cycling leads to a gradual deterioration in the physical and mechanical integrity of the exposed outer charge transport layer leading to premature onset of fatigue charge transport layer cracking. The cracks developed in the charge transport layer as a result of dynamic belt fatiguing are found to manifest themselves into copy print out defects which thereby adversely affect the image quality on the receiving paper. In essence, the appearance of charge transport cracking cuts short the imaging member belt's intended functional life.

When a production web stock of several thousand feet of coated multilayered photoreceptor material is obtained after finishing the charge transport layer coating and drying process, curling of the multilayered photoreceptor is observed and requires an anticurl backing layer applied to the backside of the substrate support, opposite to the side having the charge transport layer, to offset the curl and render the photoreceptor web stock flat. The exhibition of photoreceptor curling after completion of charge transport layer coating has been determined to be the consequent of thermal contraction mismatch between the applied charge transport layer and the substrate support under the conditions of elevated temperature, heating and drying the wet coating and the eventual cooling down to room temperature. Since the charge transport layer in a typical prior art photoreceptor device has a coefficient of thermal contraction approximately 3½ times larger than the substrate support, the charge transport layer, upon cooling down to room ambient, results in greater dimensional contraction than that of the substrate support causing photoreceptor curling.

Although it has been desirable to have the anticurl backing layer to complete a photoreceptor web stock material package, an anticurl backing layer application represents an additional coating step increasing labor and material cost, which can result in a decrease of daily photoreceptor production through-put of about 25%. Moreover, sending the photoreceptor web stock back to the coater immediately after coating the charge transport layer for anticurl backing layer application has frequently resulted in photoreceptor production yield lost due to web stock scratching caused by handling. Photoreceptors with an anticurl backing layer have a built-in internal strain of about 0.28% in the charge transport layer. This strain is cumulatively added to each photoreceptor bending induced strain as the photoreceptor belt flexes over a variety of belt module support rollers during cycling within a machine. This internal built-in strain exacerbates the fatigue charge transport layer failure and promotes the onset of charge transport layer cracking.

Imaging members having an anticurl backing layer not only require one addition coating step to complete the finish production, but also create an environmental issue involving solvent emission release to the atmoshere.

Seamed flexible photoreceptor belts are fabricated from sheets cut from a electrophotographic imaging member web stock having anticurl backing layer. The cut sheets are generally rectangular in shape. All edges may be of the same length or one pair of parallel edges may be longer than the other pair of parallel edges. The sheet is formed into a belt by joining the overlapping opposite marginal end regions of the sheet. A seam is typically produced in the overlapping opposite marginal end regions at the point of joining. Joining may be effected by means such as welding (including ultrasonic processes), gluing, taping, or pressure/heat fusing. However, ultrasonic seam welding is generally the preferred method of joining because it is rapid, clean (no application of solvents) and produces a thin and narrow seam. The ultrasonic seam welding process involves a mechanical pounding action of a welding horn which generate a sufficient amount of heat energy at the contiguous overlapping marginal end regions of the imaging member sheet to maximize melting of one or more layers therein. A typical ultrasonic welding process is carried out by pressing down the overlapping ends of the flexible imaging member sheet onto a flat anvil and guiding the flat end of the ultrasonic vibrating horn transversely across the width of the sheet and directly over the overlapped junction to form a welded seam having two adjacent seam splashings consisting of the molten mass of the imaging member layers ejected to either side of the welded overlapped seam. These seam splashings of the ejected molten mass comprise about 40% by weight of the anticurl backing layer material.

In a related photoreceptor device, an anticurl backing layer having filler reinforcement for robust mechanical function may also have bubbles in the material matrix which negate and diminish the benefit of wear resistance enhancements, otherwise achievable through dispersion of inorganic or organic particles in the layer for increasing wear resistance. Also, due to the presence of bubbles, a weakening of the layer and onset of mechanical failure can occur when fatigue tension/compression strain is repeatedly applied to the anticurl backing layer during machine cycling, particularly when cycling around small diameter support rollers. Further, when rear erase is employed to discharge the photoreceptor belt during electrophotographic imaging processes, the presence of bubbles causes a light scattering effect which leads to undesirable non-uniform discharge. Also, the presence of bubbles in the anticurl backing layer during seam welding processes can cause the bubbles to expand and form splashings exhibiting open pits. During electrophotographic imaging and cleaning cycles, these open pits can function as sites that trap toner, debris, and dirt particles making attempts to clean the imaging member belt extremely difficult. It has also been found that, during imaging belt cycling, the trapped toner, debris, and dirt particles can be carried out by the cleaning blade from the pits to contaminate the vital imaging components such as the lenses, Hybrid Scavengeless Development subsystems (HSD), Hybrid Jumping Development subsystems (HJD) and, other subsystems, and can also lead to undesirable artifacts which form undesirable printout defects in the final image copies.

Another disadvantage of photoreceptors having an anticurl backing layer occurs under dynamic belt cycling function conditions. The anticurl backing layer is in constant mechanical interaction with the machine belt support rollers and backer bars causing the anticurl backing layer to develop substantial premature wear problems. Anticurl backing layer wear reduces the thickness of the anticurl layer and diminishes the desired flattening effect. This loss of anticurl layer thickness results in non-uniform charging density at the photoreceptor belt surface under normal imaging processing conditions.

With the above noted undesirables mentioned, fabrication of flexible seamed photoreceptor belts without the need of an anticurl layer not only can reduce the belts unit manufacturing cost and increase belt yield and daily production through-put, but provide photoreceptor belts with extended mechanical functioning life and suppression of early onset of fatigue charge transport layer cracking problems. Although attempts have been made to overcome these problems, the solution of one problem often leads to the generation of additional problems.

In U.S. Pat. No. 5,089,369 to R. Yu, issued on Feb. 18, 1992, an electrophotographic imaging member having a supporting substrate and a charge generating layer, the supporting substrate material having a thermal contraction coefficient which is about the same as that of the charge generating layer. Substrate materials are disclosed that have a thermal contraction coefficient value between about $5.0\times10^{-5}/°$ C. and about $9.0\times10^{-5}/°$ C. for use in combination with a benzimidazole perylene charge generating layer.

U.S. Pat. No. 5,167,987 to R. Yu, issued on Dec. 1, 1992, discloses a process for fabricating an electrostatographic imaging member including providing a flexible substrate comprising a solid thermoplastic polymer, forming an imaging layer coating including a film forming polymer on the substrate, heating the coating and substrate, cooling the coating and substrate, and applying sufficient predetermined biaxial tensions to the substrate while the imaging layer coating and substrate are at a temperature greater than the Glass Transition Temperature (Tg) of the imaging layer coating to substantially compensate for all dimensional thermal contraction mismatches between the substrate and the imaging layer coating during cooling of the imaging layer coating and the substrate, removing application of the biaxial tensions to the substrate, and cooling the substrate whereby the final hardened and cooled imaging layer coating and substrate are free of internal stress and strain.

U.S. Pat. No. 4,983,481 to R. Yu, issued on Jan. 8, 1991, discloses an imaging member without an anti-curl backing layer is disclosed having improved resistance to curling. The imaging member comprises a flexible supporting substrate layer, an electrically conductive layer, an optional adhesive layer, a charge generating layer, and a charge transport layer, the supporting substrate layer having a thermal contraction coefficient substantially identical to the thermal contraction coefficient of the charge transport. The supporting substrate may be a flexible biaxially oriented layer.

While the above mentioned flexible imaging members may be useful for their intended purpose of resolving specific problems and improving imaging members' function, resolution of one problem has often been found to create new ones. For example, the selection of a supporting substrate, for example, polyether sulfone or MAKROFOL® having thermal contraction matching with that of the MAKROFOL® found in the coated charge transport layer to effect the suppression of electrophotographic imaging member curling, has been observed to be susceptible to attack and damage by solvents used in the charge transport layer coating solution, rendering the imaging member useless. Other substrate supports, having good thermal contraction matching properties such as TEDLAR or MELINAR, though yielding curl-free electrophotographic imaging members without anticurl back coating, have inherently low Glass Transition Temperatures (Tg), and were judged not suitable for imaging member fabrication. Application a biaxial tensioning stress onto imaging members maintained at an elevated temperature slightly above the Glass Transition Temperature (Tg) of the charge transport layer was found to be a cumbersome batch process, which is very costly to implement in imaging member production. There continues to be a need for improved methodology useful for fabricating imaging members, particularly specific substrate support material selection free of solvent attack and effects the elimination of anticurl backing layer, for multilayered electrophotographic imaging members fabrication to provide mechanically robust imaging member belts machines.

SUMMARY OF THE INVENTION

It is a feature of the present invention to provide an improved flexible multilayered electrostatographic imaging member belt involving selection of a substrate support material to effect the elimination of anticurl backing layer and render the imaging member belt flat.

Another feature of the present invention is to provide an improved methodology for fabricating flexible electrostatographic imaging member webstocks that minimize solvent emission to the environment.

The present invention in embodiments provides an improved multilayered flexible electrostatographic imaging member webstock production method that cuts costs, reduces yield lost and increases daily imaging member webstock production through-put;

an improved flexible multilayered electrostatographic imaging belt having a reduced seam splashing size to ease cleaning blade mechanical sliding action as well as minimize blade wear, as well as improving the imaging member belt motion quality during dynamic belt machine function;

an improved multilayered flexible electrophotographic imaging member belt having a charge transport layer that is free of internal stress and strain;

an improved multilayered flexible electrophotographic imaging member belt with improved resistance to premature onset of dynamic fatigue bending induced charge transport layer cracking as well as suppressing the development seam cracking and delamination when imaging member belt cyclic flexing over various belt support module rollers under machine imaging function conditions;

an electrophotographic imaging member comprising a flexible substrate support layer selected for the present invention application then coated over with an electrically conductive substrate surface layer, a hole blocking layer, an optional adhesive layer, a charge generating layer, and a charge transport layer having a thermal contraction coefficient value substantially matched to that of the substrate support layer. To yield the desired imaging member flatness without the requirement of an anticurl backing layer, the substrate support layer and the charge transport layer have a thermal contraction coefficient difference of from about $-2\times10^{-5}/°$ C. to about $+2\times10^{-5}/°$ C.; and in embodiments, a difference in thermal contraction coefficient of from about $-1\times10^{-}5/°$ C. to about $+1\times10^{-5}/°$ C. In a specific embodiment, the difference in the thermal contraction coefficient between the substrate support and charge transport layer is from about $-0.5\times10^{-5}/°$ C. and about $+0.5\times10^{-5}/°$ C. Furthermore, the selected substrate support should also have a Glass Transition Temperature (Tg) of at least 100° C., wherein the substrate support is not susceptible to attack by the solvent used in the charge transport layer coating solution, and can also conveniently be welded into an overlapped seamed flexible imaging member belt by an ultrasonic seam welding process. One substrate support is a modified thermoplastic polyimide represented by the following formulas:

(I)

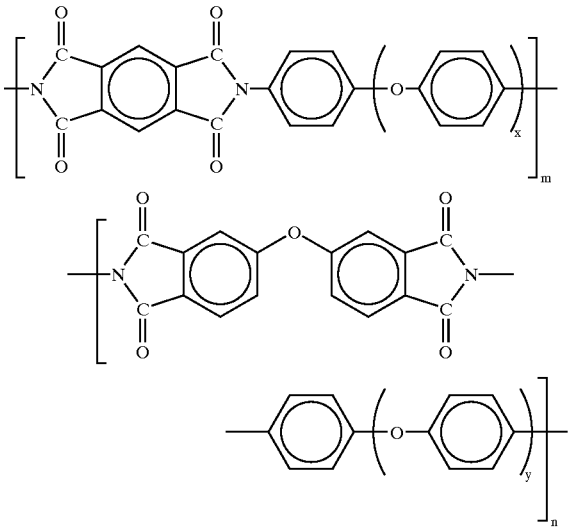

(II)

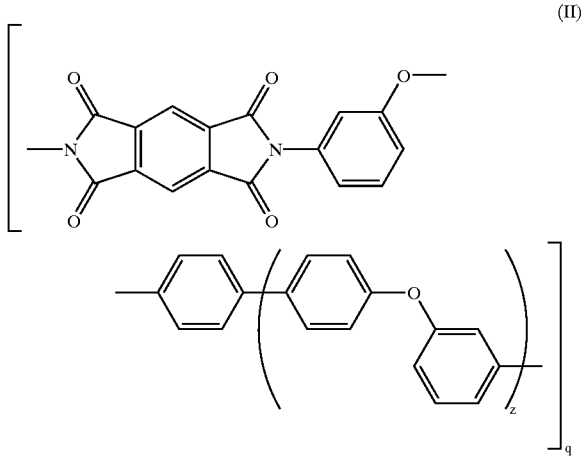

wherein, m, n, and q represent the degree of polymerization for example numbered from about 10 to about 300, or from about 50 to about 125 and x, y, represent the number of segments and z, the number of repeating units are integers, for example, x and y are from about 2 to about 10, or from about 3 to about 7. Whereas z is from about 1 to about 10, or from about 3 to about 7.

The discussions hereinafter relate to fabricating flexible electrophotographic imaging member belts (photoreceptor belts) and are equally applicable to fabricating electrographic imaging members (e.g., ionographic belts).

Flexible electrophotographic imaging member belts generally comprise a flexible supporting substrate having an electrically conductive surface layer, an optional hole blocking layer, an optional adhesive layer, a charge generating layer, a charge transport layer, an anticurl backing layer, an optional ground strip layer and an optional overcoating layer. The flexible substrate support layer which in embodiments may be transparent and have a thickness of about 25 micrometers to about 200 micrometers. A thickness of from about 50 micrometers to about 125 micrometers gives optimum light transmission and a rigid substrate support layer. The conductive surface layer coated over the flexible substrate support may comprise any electrically conductive material such as, for example, aluminum, titanium, nickel, chromium, copper, brass, stainless steel, silver, carbon black, graphite, and the like. The electrically conductive surface layer coated above the flexible substrate support layer may vary in thickness over a substantially wide range depending on the desired usage of the electrophotographic imaging member. However, in embodiments, the thickness of the conductive surface layer may be from about 20 Angstroms to about 750 Angstroms. It is, nonetheless, desirable that the conductive surface layer coated over the flexible substrate support layer have a thickness from about 50 Angstroms to about 120 Angstroms in thickness to provide sufficient light energy transmission of at least 20% transmittancy to allow effective imaging member belt back erase.

DETAILED DESCRIPTION OF THE DRAWINGS

Figure 1:
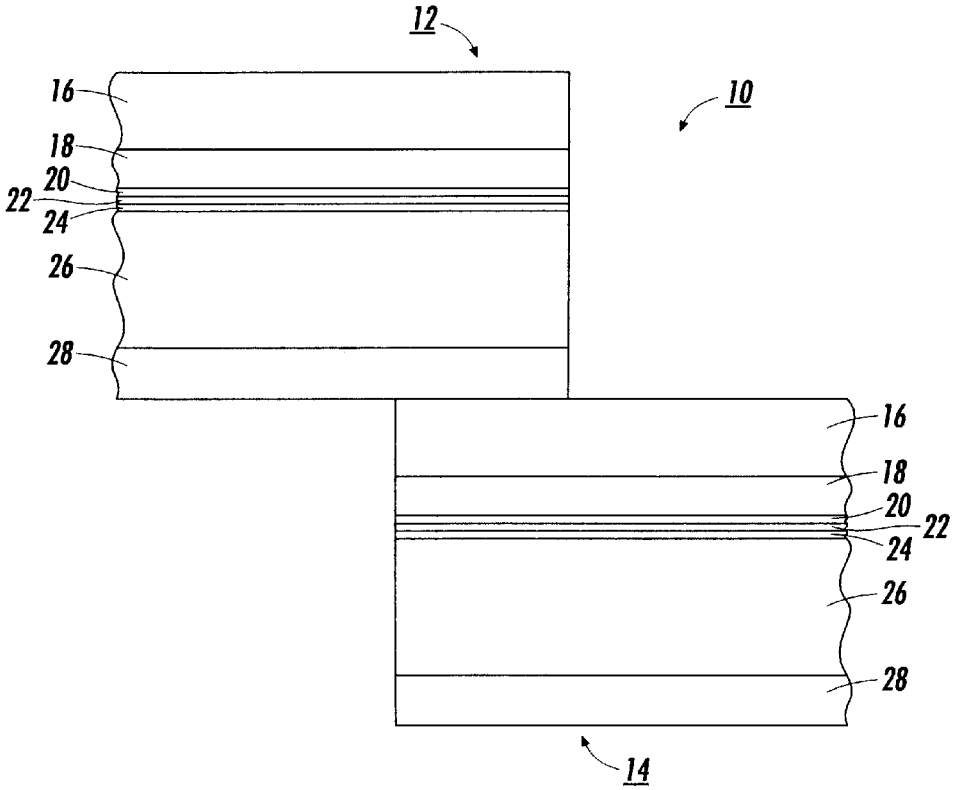
FIG. 1 illustrates a schematic partial cross-sectional view of a typical prior art multiple layered flexible sheet of electrophotographic imaging material with opposite ends overlapped.

Although specific terms are used in the following description for the purposes of clarity, these terms are intended to refer only to the particular structure of the invention selected for illustration in the drawings, and are not intended to define or limit the scope of the invention.

Referring to FIG. 1, there is illustrated an electrophotographic flexible imaging member 10 in the form of a sheet having a first end marginal region 12 overlapping a second end marginal region 14 to form an overlap region ready for a seam forming operation. The flexible imaging member 10 can be utilized within an electrophotographic imaging member device and may be a member having a flexible substrate support layer combined with one or more additional coating layers. At least one of the coating layers comprises a film forming binder.

The flexible imaging member sheet 10 may comprise multiple layers. If the flexible imaging member sheet 10 is to be a negatively charged photoreceptor device, the flexible imaging member sheet 10 may comprise a charge generator layer sandwiched between an electrically conductive substrate surface layer (coated over the flexible substrate support layer) and a charge transport layer. Alternatively, the flexible member sheet 10 may comprise a charge transport layer sandwiched between a conductive surface layer and a charge generator layer.

The layers of the flexible imaging member sheet 10 can comprise numerous coating layers containing materials of suitable mechanical properties. Examples of typical layers are described in U.S. Pat. No. 4,786,570, U.S. Pat. No. 4,937,117 and U.S. Pat. No. 5,021,309, the entire disclosures of which are incorporated herein by reference. The cut sheet of flexible imaging member sheet 10 with overlapping ends shown in FIG. 1, including the two end marginal regions 12 and 14, comprises from top to bottom a charge transport layer 16, a generator layer 18, an interface layer 20, a blocking layer 22, an electrically conductive substrate surface layer 24, a flexible supporting substrate layer 26, and an anti-curl back coating layer 28 which maintains imaging member flatness.

Figure 2:
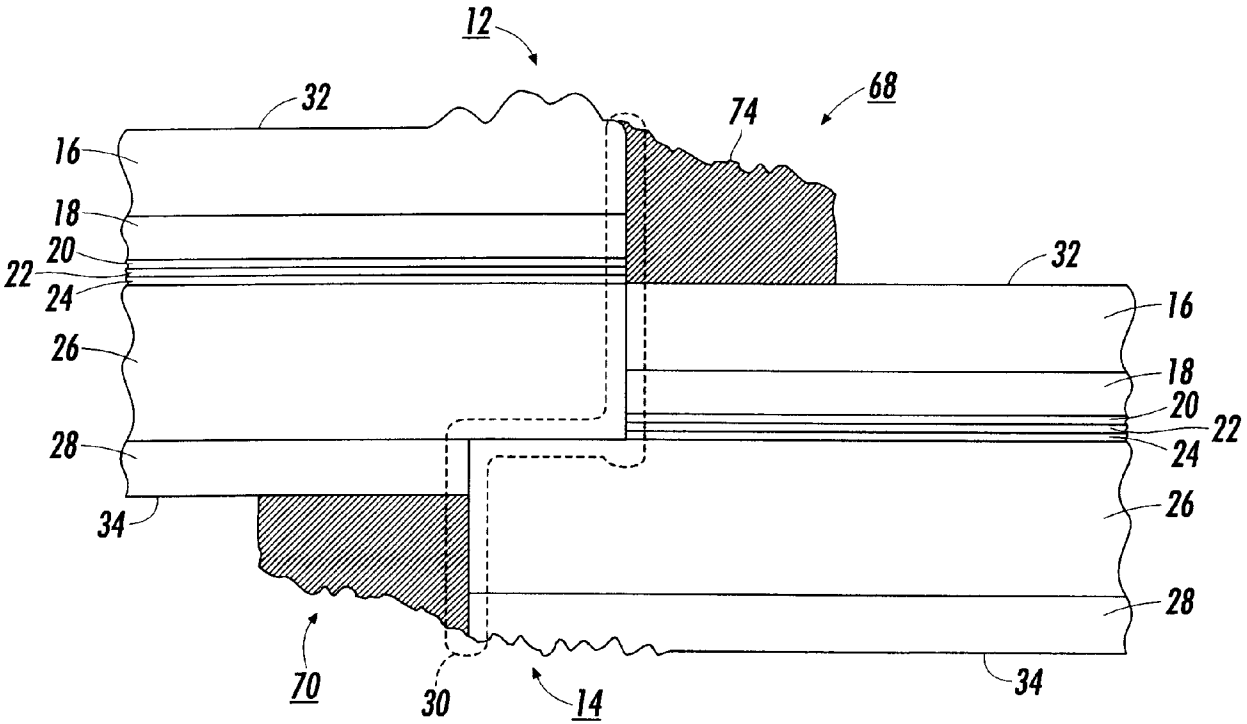
FIG. 2 shows a schematic partial cross-sectional view of a typical prior art multiple layered seamed flexible electrophotographic imaging belt derived from the sheet illustrated in FIG. 1 after ultrasonic seam welding.

Although the overlapping end marginal regions 12 and 14 can be joined by different means including ultrasonic welding, gluing, taping, stapling, and pressure and heat fusing to form a continuous imaging member seamed belt, sleeve, or cylinder, in embodiments, from the viewpoint of considerations such as ease of belt fabrication, short operation cycle time, and mechanical strength of the fabricated joint, the ultrasonic welding process is, in embodiments, used to join the overlapping end marginal regions 12 and 14 of flexible imaging member sheet 10 into a seam 30 in the overlapping region, as illustrated in FIG. 2, to form a seamed flexible electrophotographic imaging member belt. As shown in FIG. 2, the location of seam 30 is indicated by an encircling dotted line, thereby seam 30 comprises two vertical portions joined by a horizontal portion. Since the midpoint of seam 30 may be represented by an imaginary centerline extending the length of seam 30 from one edge to the opposite edge of the seamed belt, thus the imaginary centerline (not shown) running along the middle of the horizontal portion which joins the two vertical portions illustrated in FIG. 2. In other words, the horizontal portion of seam 30 is a strip much like a two lane highway in which the centerline is represented by the white divider line separating the two lanes, the two lanes comprising end marginal regions 12 and 14. The flexible electrophotographic imaging member sheet 10 is thus transformed from a cut sheet of imaging member material having desirable dimensions as illustrated in FIG. 1 into a continuous flexible electrophotographic imaging member seamed belt as pictorially represented in FIG. 2. The flexible imaging member seamed belt has a first major exterior or top surface 32 and a second major exterior or bottom surface 34 on the opposite side. The seam 30 joins the two overlapping ends of flexible imaging member sheet 10 so that the bottom surface 34 (generally including at least one layer immediately above) at and/or near the first end marginal region 12 is integral with the top surface 32 (generally including at least one layer immediately below) at and/or near the second end marginal region 14.

When an ultrasonic welding process is employed to transform the sheet of flexible electrophotographic imaging member material into an imaging member seamed belt, the seam of the belt is created by the high frequency mechanical pounding action of a welding horn over the overlapped opposite end regions of the imaging member sheet to cause material fusion. In the ultrasonic seam welding process, ultrasonic energy generated by the welding horn action, in the form of heat is applied to the overlap region to melt layers such as the charge transport layer 16, generator layer 18, interface layer 20, blocking layer 22, conductive layer 24, a small part of the substrate support layer 26, and the anticurl backing layer 28 as well. Therefore, direct material fusing at the interface between the contacting surfaces of the two overlapping ends of the substrate support layer provides best adhesion bonding to give highest seam rupture strength.

Figure 3:
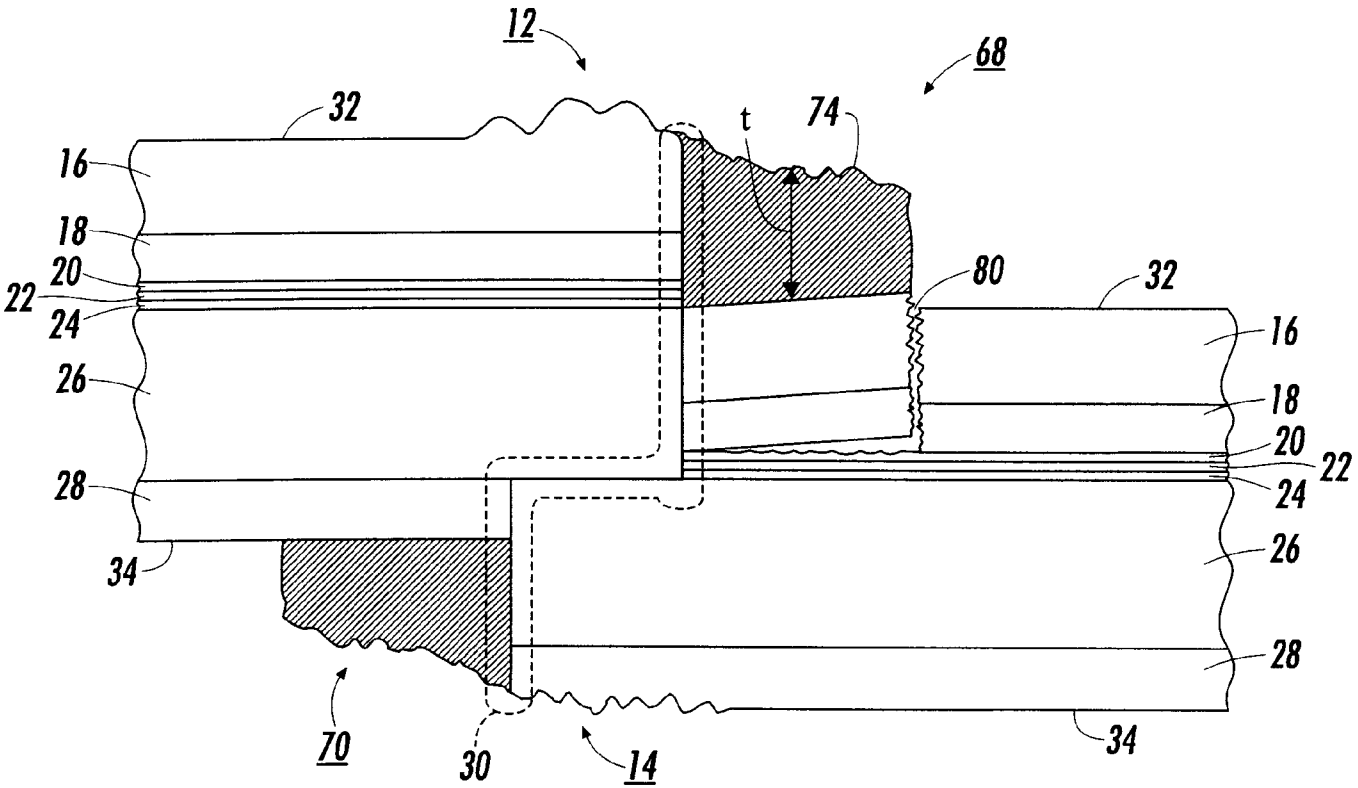
FIG. 3 illustrates a schematic partial cross-sectional view of a multiple layered seamed flexible electrophotographic imaging belt which has failed due to fatigue induced seam cracking and delamination.

Upon completion of welding of the overlapping region of the imaging member sheet into a seam 30 with the ultrasonic seam welding techniques, the overlapping ends are converted into an abutting region shown in FIGS. 2 and 3. Within the abutting region, the portions of the flexible imaging member seamed belt, which once formed the end marginal regions 12 and 14, are joined by the seam 30 such that the end marginal regions 12 and 14 are abutting one another. The welded seam 30 contains top and bottom splashings 68 and 70 as illustrated in FIGS. 2 and 4. The splashings 68 and 70 are formed in the process of joining the end marginal regions 12 and 14 together. Molten mass of materials, consisting of all of the imaging member layers at inside domain of the overlapping ends, are necessarily ejected to either side of the overlap region to facilitate direct substrate support layer 26 of one end to substrate support layer 26 of the opposite end fusing and results in the formation of two splashings 68 and 70 at the ether side of the welded seam 30. The top splashing 68 is formed and positioned above the overlapping end marginal region 14 abutting the top surface 32 and adjacent to and abutting the overlapping end marginal region 12. The bottom splashing 70 is formed and positioned below the overlapping end marginal region 12 abutting bottom surface 34 and adjacent to and abutting the overlapping end marginal region 14. The seam splashings 68 and 70 are found to extend beyond the two imaging member belt edges or sides in the overlap region of the welded flexible imaging member seamed belt after welding processing. Since the extensions of the seam splashings 68 and 70 beyond the two belt edges, they are determined to be undesirable for many machines such as electrophotographic copiers, duplicators and copiers that require precise edge positioning of a flexible member seamed belt during machine operation; therefore, the splashing extensions are removed or notched out from the two belt edges with a puncher. Moreover, the large physical sizes of seam splashings 68 and 70, projecting outwardly over the two exterior surfaces 32 and 34, respectively, of the belt, are also problematic, because the bottom splashing 70 interacts physically with all the belt support rollers and the backer bars of the belt module to affect the imaging member belt's dedicate motion/transporting speed, while the top splashing 68 with a rough surface morphology 74 mechanically interferes with the cleaning blade sliding action to nick the blade and exacerbate blade wear as well causing it's the cleaning blades' premature loss of cleaning efficiency during electrophotographic imaging member belt machine function. Typical seam splashing, either 68 or 70, has a height or thickness of about 80 micrometers physical projection away from each respective belt surface 32 or 34.

Under machine electrophotographic imaging and cleaning operation conditions, the flexible imaging member seamed belt cycles or bends over rollers, particularly small diameter rollers, of a machine belt support module within an electrophotographic imaging apparatus. As a result of dynamic fatigue of the flexible imaging member seamed belt during cycling, the combination effects generated by bending over belt all the belt module supporting rollers as well as the cleaning blade mechanical interaction does create a repetitive force exerted on the seam region of the flexible imaging member seamed belt, causing large tension stresses to develop at the vicinity adjacent to the seam 30 due to the excessively large seam splashing size 68 and its material and geometrical discontinuity thereof. The detrimental effect of stress concentration compounded by the repeating cleaning blade striking/impact on the seam during imaging member belt cycling has been seen to promote the early development of seam cracking/delamination failure 80 as shown in FIG. 3. The seam cracking, delamination failure 80 does act as a depository site; it collects toner, paper fibers, dirt, debris and other unwanted materials during electrophotographic imaging and cleaning processes of the flexible imaging member seamed belt. For example, during the cleaning process, a cleaning instrument, such as a cleaning blade, will repeatedly pass over the cracking/delamination site 80. As the cracking/delamination site 80 becomes filled with debris, the cleaning instrument dislodges at least a portion of this highly concentrated level of debris from this site. The amount of the debris, however, is beyond the removal capacity of the cleaning instrument. As a consequence, the cleaning instrument dislodges the highly concentrated level of debris but cannot remove the entire amount during the cleaning process. Instead, portions of the highly concentrated debris is deposited onto the surface of the flexible imaging member seamed belt. In effect, the cleaning instrument spreads the debris across the surface of the flexible imaging member seamed belt instead of removing the debris therefrom.

In addition to seam failure and debris spreading, the portion of the flexible imaging member seamed belt above the seam cracking/delamination site 80, in effect, becomes a flap which moves upwardly. The upward movement of the flap presents an additional problem during the cleaning operation. The flap becomes an obstacle in the path of the cleaning instrument as the instrument travels across the surface of the flexible imaging member seamed belt. The cleaning instrument eventually strikes the flap when the flap extends upwardly. As the cleaning instrument strikes the flap, great force is exerted on the cleaning instrument which can lead to damage, e.g., excessive wear, nicking, and tearing of the cleaning blade.

Besides damaging the cleaning blade, the striking of the flap by the cleaning instrument causes unwanted vibration in the flexible imaging member seamed belt. This unwanted vibration adversely affects the copy/print quality produced by the flexible imaging member seamed belt. The copy quality in print is affected because imaging occurs on one part of the flexible imaging member seamed belt simultaneously with the cleaning of another part of the flexible imaging member seamed belt.

As it is known from the principles of material mechanics, when the flexible imaging member seamed belt bends over the exterior surfaces of rollers of a belt module within an electrophotographic imaging apparatus, the bottom surface 34 of the flexible imaging member seamed belt is compressed. In contrast, the top surface 32 is stretched under tension. This is attributable to the fact that the top surface 32 and bottom surface 34 move in a circular path about the circular roller. Since the top surface 32 is at greater radial distance from the center of the circular roller than the bottom surface 34, the top surface 32 must travel a greater distance than the bottom surface 34 in the same time period. Therefore, the top surface 32 must be stretched under tension relative to a generally central portion of the flexible imaging member seamed belt (the portion of the flexible imaging member seamed belt generally extending along the center of gravity of the flexible imaging member seamed belt). Likewise, the bottom surface 34 must be compressed relative to the generally central portion of the flexible imaging member seamed belt (the portion of the flexible imaging member seamed belt generally extending along the center of gravity of the flexible imaging member seamed belt). Consequently, the bending stress at the belt top surface 32 will be tension stress, and the bending stress at the belt bottom surface 34 will be compression stress as the imaging member seamed belt flexes over each belt module support roller under a machine functioning condition.

It has also been well established by fracture mechanics that compression stresses, such as that at the bottom belt surface 34, do rarely cause seam 30 failure. Tension stresses, such as that induced at the top belt surface 32, however, are a more serious problem. The tension stress, under constant fatiguing condition, has been determined to be a cause of the development of charge transport layer 16 cracking problem, because the cracks though initiated in the charge transport layer 16 do continue to propagate to the generator layer 18 and beyond. Inevitably, each crack extends to the interface layer 20, cuts through to the blocking layer 22, and reaches the conductive layer 24. These fatigue induced cracks in the coating layers of the imaging member seamed belt are seen to manifest themselves into copy printout defects. Consequently, the usefulness and service life of the flexible imaging member seamed belt is shortened from about 105,000 belt cycles for an imaging member belt of the present invention to about 47,000 belt cycles for a imaging belt member counterpart when dynamically tested in an imaging machine utilizing a belt support module equipped with two 19 millimeter diameter rollers.

However, since the typical prior art flexible electrophotographic imaging member seamed belts utilize a flexible substrate support having a thermal contraction coefficient which is about 3.7 times greater that of the charge transport layer causing exhibition of spontaneous imaging member curling after solution charge transport layer coating/elevated temperature dying/cooling to room ambient due to the dimensional contraction mismatch between these two layers, the imaging members do, for this reason, require an anticurl backing layer applied to the back side of the substrate support layer to create a counteracting effect that balances the upward lifting force and renders the imaging member flat prior to belt preparation. Therefore, the prior art imaging member belts have a built-in internal strain of approximately 0.28%. The existence of this internal strain or stress built-in in the charge transport layer is additive to the bending strain induced during imaging member belts fatigue function under machine operational conditions. The cumulative effect of internal strain and bending strain promotes the development of early onset of dynamic fatigue charge transport layer cracking during imaging member belt cyclic function.

DETAILED DESCRIPTION OF EMBODIMENTS

The present invention produces an electrophotographic imaging member, having a simplified material configuration minus an anticurl backing. In an embodiment, the electrophotographic imaging member is prepared by utilizing a thermoplastic polyimide substrate support which has a thermal contraction coefficient closely matching to that of the charge transport layer, a Glass Transition Temperature (Tg) greater than 200° C., and wherein the substrate support layer is not susceptible to attack by the charge transport layer solution solvent. The resulting flexible imaging member obtained is curl free without the need of an anticurl backing layer and can be conveniently welded into a flexible seamed belt using an ultrasonic seam welding process. The specific thermoplastic polyimide substrate support that gives the invention results is selected from either of the two molecular formulas represented below:

(I)

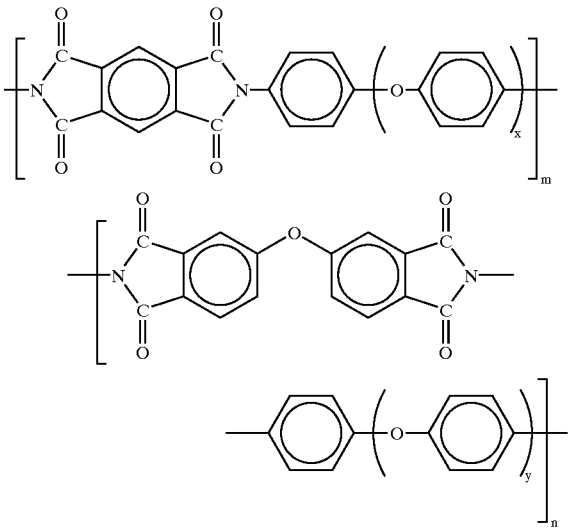

(II)

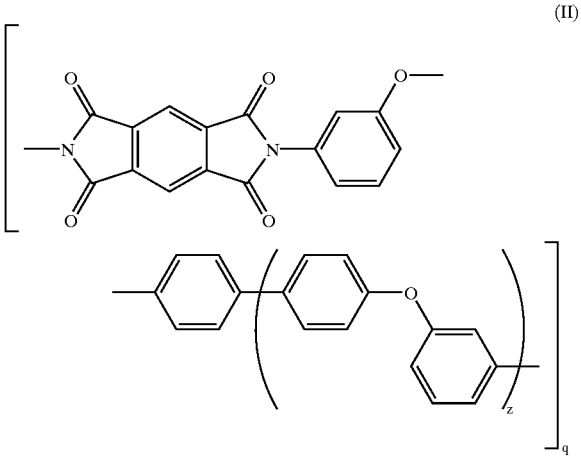

wherein, m, n, and q are degrees of polymerization having a number ranging from about 10 to about 300 and x, y, and z are integers; with x and y from 2 to 10 and z from 1 to about 10.

The thickness of the substrate support layer depends on numerous factors, including beam strength, optical transmission, and economical considerations. Thus, the substrate layer employed for a flexible electrophotographic imaging member belt fabrication may have a thickness from about 25 micrometers to about 200 micrometers. However, in an embodiment a thickness of from about 50 micrometers to about 125 micrometers is, in embodiments preferred based on optimum light energy transmission for effective back erase and substrate's beam rigidity consideration.

The conductive layer on the flexible substrate may vary in thickness over substantially wide ranges depending on the optical transparency and degree of flexibility desired for the electrostatographic member. Accordingly, for a flexible photoresponsive imaging device, the thickness of the conductive layer may be from about 20 angstrom units to about 750 angstrom units, and more preferably from about 100 Angstrom units to about 200 angstrom units for an optimum combination of electrical conductivity, flexibility and light transmission. The electrically conductive substrate surface layer may be an electrically conductive metal layer formed, for example, on the substrate by different coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. In embodiments, for rear erase exposure, an electrically conductive substrate surface layer light transparency of at least about 15% is desirable. The electrically conductive substrate surface layer need not be limited to metals. Other examples of electrically conductive substrate surface layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer.

An optional charge blocking layer may be applied to the electrically conductive substrate surface layer prior to or subsequent to application of the anticurl backing layer to the opposite side of the substrate. Generally, electron blocking layers for positively charged photoreceptors allow holes from the imaging surface of the photoreceptor to migrate toward the conductive layer. Any blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033 and U.S. Pat. No. 4,291,110, the disclosures of which are incorporated herein by reference. In embodiments, a preferred blocking layer comprises a reaction product between a hydrolyzed silane and the oxidized surface of a metal ground plane layer. The blocking layer may be applied by different techniques such as spraying, dip coating, draw bar coating, gravure coating, silk screening, air knife coating, reverse roll coating, vacuum deposition, chemical treatment and the like. For convenience in obtaining thin layers, the blocking layers in embodiments are preferably applied in the form of a dilute solution, with the solvent being removed after deposition of the coating by techniques such as by vacuum, heating and the like. The blocking layer should be continuous and have a thickness of less than about 0.2 micrometer. A greater thickness may lead to undesirably high residual voltage.

An optional adhesive layer may be applied to the hole blocking layer. Typical adhesive layer materials include, for example, polyesters, DuPont 49,000 (available from E. I. Du Pont de Nemours and Company), Vitel PE100 (available from Goodyear Tire & Rubber), and polyurethanes. In embodiments, satisfactory results may be achieved with adhesive layer thickness from about 0.05 micrometer (500 Angstroms) to about 0.3 micrometer (3,000 Angstroms). Techniques for applying an adhesive layer coating mixture to the charge blocking layer include spraying, dip coating, roll coating, wire wound rod coating, gravure coating, bird applicator coating, and the like. Drying of the deposited coating may be effected by techniques such as oven drying, infrared radiation drying, air drying and the like.

A photogenerating layer may be applied to the adhesive blocking layer which can then be overcoated with a contiguous hole transport layer as described hereinafter. Examples of I photogenerating layers include inorganic photoconductive particles such as amorphous selenium, trigonal selenium, and selenium alloys comprising selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, the disclosure of which is incorporated herein by reference, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 tradenames for dibromo anthanthrone pigments, benzimidazole perylene, substituted 2,4-diamino-triazines disclosed in U.S. Pat. No. 3,442,781, the disclosure of which is incorporated herein by reference, polynuclear aromatic quinones available from Allied Chemical Corporation under the tradename Indofast Double Scarlet, Indofast Violet Lake B, Indofast Brilliant Scarlet and Indofast Orange, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated by reference. Other photogenerating materials known in the art may also be utilized. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be utilized because of their sensitivity to white light. Vanadyl phthalocyanine, metal-free phthalocyanine and tellurium alloys may also be incorporated because these materials provide sensitivity to infrared light.

A polymeric film forming binder material may be employed as the matrix in the photogenerating binder layer. Typical polymeric film forming materials include those described, for example, in U.S. Pat. No. 3,121,006, the disclosure of which is incorporated herein by reference. Organic polymeric film forming binders include thermoplastic and thermosetting resins including polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in amounts, generally, from about 5% by volume to about 90% by volume of the photogenerating pigment and is dispersed in from is dispersed in about 10% by volume to about 95% by volume of the resinous binder, and in embodiments preferably from about 20% by volume to about 30% by volume of the photogenerating pigment is dispersed in about 70% by volume to about 80% by volume of the resinous binder composition. In one embodiment about 8% by volume of the photogenerating pigment is dispersed in about 92% by volume of the resinous binder composition.

The photogenerating layer containing photoconductive compositions and/or pigments and the resinous binder material generally ranges in thickness of from about 0.1 micrometers to about 5 micrometers, and in embodiments has a thickness of from about 0.3 micrometers to about 3 micrometers. The photogenerating layer thickness is related to binder content. Higher binder content compositions generally require thicker layers for photogeneration.

Numerous techniques may be utilized to mix and thereafter apply the photogenerating layer coating mixture, these techniques include spraying, dip coating, roll coating, or wire wound rod coating. Drying of the deposited coating may be effected by different techniques such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes. This converts the electrically inactive polymeric material to a material capable of supporting the injection of photogenerated holes from the generation material and capable of allowing the transport of these holes through the active layer in order to discharge the surface charge on the active layer. In an embodiment, the transport layer employed in one of the two electrically operative layers of this invention comprises from about 25% to about 75% by weight of at least one charge transporting aromatic amine compound, and from about 75% to about 25% by weight of a polymeric film forming resin in which the aromatic amine is soluble.

The charge transport layer forming mixture can comprise an aromatic amine compound. Examples of charge transporting aromatic amines for charge transport layers capable of supporting the injection of photogenerated holes of a charge generating layer and transporting the holes through the charge transport layer include triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine (m-TBD), and the like dispersed in an inactive resin binder.

An inactive thermoplastic resin binder soluble in methylene chloride or other solvent may be employed in the process of this invention to form the thermoplastic polymer matrix of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000.

Different techniques may be utilized to mix and thereafter apply the charge transport layer coating mixture to the charge generating layer. Typical application techniques include spraying, dip coating, roll coating, wire wound rod coating, and the like. Drying of the deposited coating may be effected by different techniques such as oven drying, infra red radiation drying, air drying and the like.

Generally, the thickness of the charge transport layer is from about 10 to about 50 micrometers, but thicknesses outside this range can also be used. In general, the ratio of the thickness of the hole transport layer to the charge generator layer is in embodiments from about 2:1 to 200:1 and in some instances from about 2:1 to about 400:1.

In embodiments electrically inactive resin materials are polycarbonate resins having a weight average molecular weight Mw, of from about 20,000 to about 150,000, and in embodiments from about 50,000 to about 120,000. In embodiments, the electrically inactive resin material may include poly(4,4'-dipropylidene-diphenylene carbonate) with a weight average molecular weight Mw, of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as MAKROLON from Farbenfabricken Bayer A.G. and a polycarbonate resin having a molecular weight of from about 20,000 to about 50,000 available as MERLON from Mobay Chemical Company. Methylene chloride is used as a solvent in the charge transport layer coating mixture for its low boiling point and the ability to dissolve charge transport layer coating mixture components.

Examples of photosensitive members having at least two electrically operative layers including the charge generator layer and diamine containing transport layer members are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures of which are incorporated herein by reference. The photoreceptors may comprise, for example, a charge generator layer sandwiched between a conductive surface and a charge transport layer as described above or a charge transport layer sandwiched between a conductive surface and a charge generator layer.

The charge transport layer may comprise electrically active resin materials or mixtures of inactive resin materials with activating compounds. Electrically active resin materials are well known in the art. Typical electrically active resin materials include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532. Polyvinylcarbazole and derivatives of Lewis acids described in U.S. Pat. No. 4,302,521, the disclosures of which are incorporated herein by reference. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly (cyclotrimethylene silylene), poly(cyclotetramethylene silylene), poly(cyclopentamethylene silylene), poly(di-t-butyl silylene-co-di-methyl silylene), poly(diphenyl silylene-co-phenylmethyl silylene), poly(cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516, the disclosures of which are incorporated herein by reference.

The imaging member may contain other layers such as a electrically conductive ground strip in contact with the conductive layer, a blocking layer, an adhesive layer, and a charge generating layer. Ground strips are well known and comprise conductive particles dispersed in a film forming binder.

An optional overcoat layer, if desired, may also be utilized to protect the charge transport layer and improve resistance to abrasion. These overcoat layers are known in the art and may comprise thermoplastic organic polymers or inorganic polymers that are electrically insulating or slightly conductive.

For electrographic imaging members, a flexible dielectric layer overlying the conductive layer may be substituted for the active photoconductive layers. A flexible, electrically insulating, thermoplastic dielectric polymer matrix material may be used in the dielectric layer of the electrographic imaging member. If desired, the flexible belts of this invention may be used for other purposes where cycling durability is important.

COMPARATIVE EXAMPLE I

A flexible electrophotographic imaging member web stock, as shown in FIG. 1, was prepared by providing a 0.01 micrometer thick titanium layer 24 coated on a flexible biaxially oriented polyester substrate support 26, having a thermal contraction coefficient of $1.8\times10^{-5}$/° C., a glass transition temperature Tg of 130° C., and a thickness of 3 mils or 76.2 micrometers (Melinex 442, available from ICI Americas, Inc.). The titanium coated substrate support layer with an optical transmittancy of about 20% was adequately to effect back erase; and applying thereto, by a gravure coating process, a solution containing 10 grams gamma aminopropyltriethoxy silane, 10.1 grams distilled water, 3 grams acetic acid, 684.8 grams of 200 proof denatured alcohol and 200 grams heptane. This layer was then dried at 125° C. in a forced air oven. The resulting blocking layer 22 had an average dry thickness of 0.05 micrometer measured with an ellipsometer.

An adhesive interface layer was then extrusion coated by applying to the blocking layer a wet coating containing 5% by weight based on the total weight of the solution of polyester adhesive (Mor-Ester 49,000, available from Morton International, Inc.) in a 70.30 volume ratio mixture of tetrahydrofuran/cyclohexanone. The resulting adhesive interface layer 20, after passing through an oven, had a dry thickness of 0.095 micrometer.

The adhesive interface layer 20 was thereafter coated, by extrusion, with a photogenerating layer containing 7.5% by volume trigonal Selenium, 25% by volume N,N'-diphenyl-N,N'-bis(3-methylphenyl)-1,1'-biphenyl-4,4'-diamine, and 67.5% by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2.0 grams of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter extrusion coated onto the adhesive interface layer to form a coating layer having a wet thickness of 0.5 mil (12.7 micrometers). This photogenerating layer was dried at 125° C. to form a dry photogenerating layer 18 having a thickness of 2.0 micrometers.

This coated imaging member web was simultaneously extrusion overcoated with a charge transport layer (CTL) and a ground strip layer using a 3 mil gap bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a weight average molecular weight of about 120,000 commercially available from Farbensabricken Bayer A.G. The resulting mixture was dissolved to give a 15% by weight solids in 85% by weight methylene chloride. This solution was applied over the photogenerator layer 18 to form a coating which, upon drying, gave a CTL 16 thickness of 24 micrometers and a thermal contraction coefficient of $6.5\times10^{-5}$/° C.

The adhesive layer was coated with a ground strip layer during a co-coating process. This ground strip layer, after drying at 125° C. in an oven, had a dried thickness of about 14 micrometers. This ground strip was electrically grounded, by means such as a carbon brush contact means during xerographic imaging process. The electrophotographic imaging member web stock, at this point if unrestrained, would spontaneously curl upwardly into a 1½ inch diameter tube. Therefore, the application of an anticurl backing layer 28 was required to provide the desired imaging member web flatness.

An anticurl backing layer coating solution was prepared by combining 8.82 grams of polycarbonate resin (Makrolon 5705, available from Bayer AG), 0.72 gram of polyester resin (Vitel PE-200, available from Goodyear Tire and Rubber Company) and 90.1 grams of methylene chloride in a glass container to form a coating solution containing 8.9% by weight solids. The container was covered tightly and placed on a roll mill for about 24 hours until the polycarbonate and polyester were dissolved in the methylene chloride to form the anticurl coating solution. The anticurl backing layer coating solution was then applied to the rear surface of the substrate support layer 26 (the side opposite the photogenerator layer and charge transport layer) of the imaging member web stock and dried at 125° C. to produce a dried anticurl backing layer (ACBC) 28 thickness of about 13.5 micrometers. The resulting electrophotographic imaging member web stock had the desired flatness and with a structure of that schematically illustrated in FIG. 1. The fabricated electrophotographic imaging member web stock was used to serve as an imaging member control.

COMPARATIVE EXAMPLE II

Another flexible prior art electrophotographic imaging member web stock was prepared by following the procedures and using materials as described in the Comparative Example I, but with the exception that the biaxially oriented polyester substrate support layer 26 was replaced with a 4-mil thick polyether sufone having a thermal contraction coefficient of $6.0\times10^{-5}/°$ C. and a Tg of 220° C. (Stabar S 100, available from ICI Americas, Inc.). Although satisfactory matching in thermal contraction coefficient between the CTL 16 and the polyether sulfone substrate support 26 had been able to render the fabricated imaging member web stock reasonable flatness without the need of an anticurl backing layer 26, methylene chloride (solvent in the CTL coating solution) penetration through the thin titanium conductive ground plane 24 did cause the polyether sulfone substrate support 26 to develop fine lines of cracking.

COMPARATIVE EXAMPLE III

Another curl-free flexible electrophotographic imaging member web stock was prepared according to Comparative Example II, except that a 4-mil thick polyvinyl fluoride (PVF), having a thermal contraction coefficient of $7.0\times10^{-5}/°$ C. and a Glass Transition Temperature (Tg) of 32° C. (available from E. I. Du Pont de Numours Company), was used as the substrate support layer 26. The fabricated imaging member web stock though was free of imaging member curling, but slight imaging member wrinkling was noted since coating layers drying processes were all carried out at an elevated temperature of 125° C., exceeding the 32° C. Glass Transition Temperature (Tg) of the PVF substrate support layer to cause development of slight substrate deformation. Moreover, since electrophotographic imaging machines had typically operation temperature of about 46° C., low PVF substrate support Glass Transition Temperature (Tg) would result in substantial imaging member belt circumference dimension increase due to creep in compliance to the constant applied belt tension. Significant imaging member belt dimension change during machine function requires frequent costly belt replacement.

COMPARATIVE EXAMPLE IV

Another curl-free flexible electrophotographic imaging member web stock was prepared according to Comparative Example II, except that a 4-mil thick MAKROFOL®, a polycarbonate having a thermal contraction of $6.5\times10^{-5}/°$ C. and a Glass Transition Temperature (Tg) of 158° C. (available from Mobay Chemical Corporation), was used as the substrate support layer 26. The resulting curl-free imaging member had substrate damage due to solvent sensitivity of MAKROFOL® to the methylene chloride.

COMPARATIVE EXAMPLE V

Another curl-free electrophotographic imaging member web stock was prepared according to Comparative Example II, except that a 4-mil thick MELINAR, an amorphous polyethylene terephthalate polyester having a thermal contraction coefficient of $6.5\times10^{-5}/°$ C. and a Glass Transition Temperature (Tg) of 70° C. (available from ICI Inc.), was used as the substrate support layer 26. The fabricated imaging member, though without notable curling, had mild degree of member crinkling due to the condition of elevated imaging member's preparation/processing temperature at 125° C., exceeding far beyond the Tg of the substrate support layer to cause development of heat induced polymer deformation.

EXAMPLE VI

A flexible electrophotographic imaging member web stock was prepared in accordance to the procedures and using the same materials as those described in Comparative Example I, but with the exception that a 4-mil thick KAPTON KJ, a thermoplastic polyimide having a thermal contraction coefficient of $6.5\times10^{-5}/°$ C., a Glass Transition Temperature (Tg) of 210° C., optical clarity from about 70% of the radiation wave length used for imaging member belt erase to about 100% of the radiation wave length used for imaging member belt erase, and not subject to attack or adversely affected by methylene chloride (available from E. I. Du Pont de Numours and Company), was chosen for the Polyester substrate support layer 26 replacement. The molecular structure of this Polyimide is given in formula (I) below:

(I)

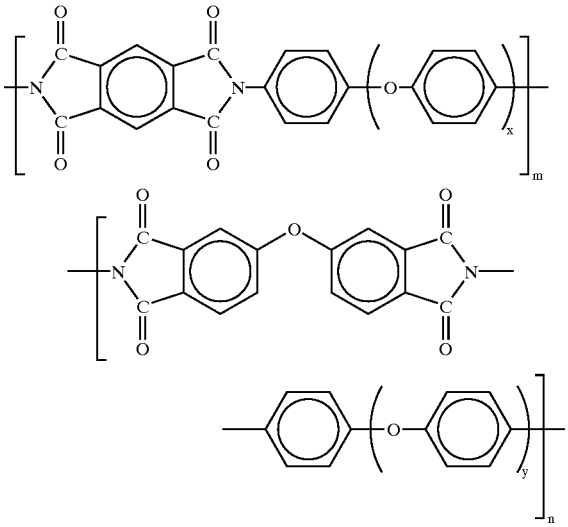

wherein, x=2 and y=2; and m and n are as illustrated herein.

Since both the polyimide substrate support 26 and the CTL 16 had similar thermal contraction coefficients, values the resulting flexible electrophotographic imaging member obtained was curl-free without the need of applying an anticurl backing layer.

EXAMPLE VII

A flexible electrophotographic imaging member web stock was prepared in accordance to Invention Example VI, with the exception that an alternate 4-mil thick thermoplastic polyimide, IMIDEX, having a thermal contraction coefficient of $6.0\times10^{-5}/°$ C., a Glass Transition Temperature (Tg) of 230° C., optical clarity from about 70% of the radiation wave length used for imaging member belt erase to about 100% of the radiation wave length used for imaging member belt erase, and not subject to attack or adversely affected by methylene chloride (available from West Lake Plastics Company), was selected for substrate support 26 replacement. The molecular structure of IMIDEX polyimide is shown in formula (II) below:

(II)

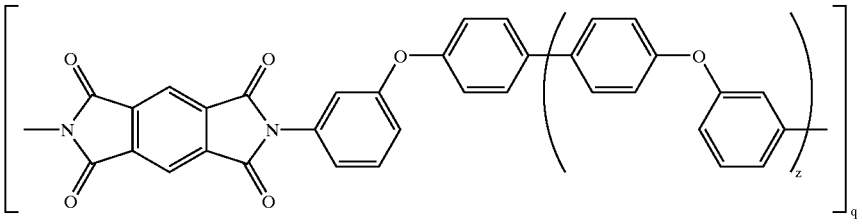

wherein, z=1 and q as illustrated herein.

The fabricated flexible electrophotographic imaging member required no anticurl backing layer to render imaging member flatness.

Commercially available polyimides, such as KAPTON F, H, and R types available from DuPont and UPILEX R and S types available from Ube Industries, LTD and can be selected from the member of the present invention are thermoset polyimide and have excellent temperature stability beyond 400° C. The molecular structures of these thermoset polyimide substrates are presented in the following formulas (III), (IV), and (V):

(III)

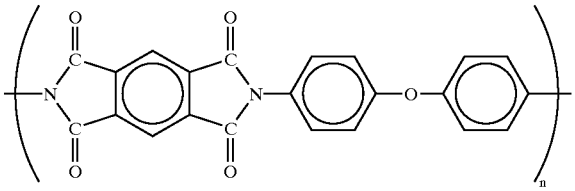

(IV)

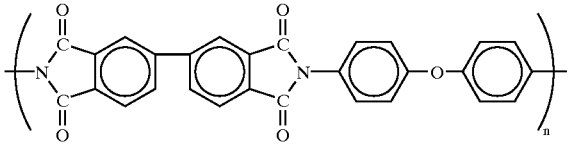

(V)

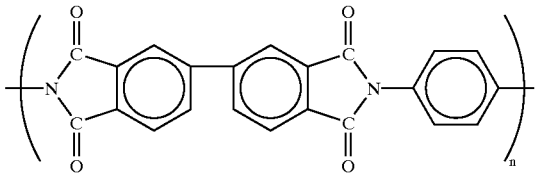

where n is as illustrated herein.

With a thermal contraction coefficient of about $1.7\times10^{-5}$/° C. to about $2.5\times10^{-5}$/° C., it is almost 4 times greater than that of the CTL. Therefore, as they were used as the substrate support for electrophotographic imaging member fabrication, each resulting imaging member did require an anticurl backing layer to provide flatness.

EXAMPLE VIII

The flexible electrophotographic imaging member web stocks of Comparative Example I and Examples VI and VII were each cut to precise dimensions of 440 mm width and 2,808 mm in length. The opposite ends of each cut imaging member sheet was secured to give 1 millimeter overlap and ultrasonically welded, utilizing 40 KHz horn frequency, in the long dimension, to form a seamed flexible imaging member belt for fatigue dynamic electrophotographic imaging test in a selected xerographic machine.

Prior to carrying out the dynamic cycling belt test, the seam splashings 68 and 70, like those shown in FIG. 2 for control imaging member belt prepared with prior art imaging member web stock of Comparative Example 1, were measured and determined with the use of a Wyko Gauxe NT-200 for physical dimensions to give an average splashing height of about 79 micrometers and with about 0.85 millimeter in width. By comparison, the splashings of seamed belts prepared from the imaging member web stocks of Invention Examples VI and VII had about 40% splash size reduction in both height and width directions; since invention imaging members had a simplified material make-up configuration without molten anticurl backing layer to form seam splashing.

The dynamic machine belt cycling test results obtained showed that the onset of seam cracking/delamination failure was significantly delayed by a factor of 2 for the invention imaging member belts over the life of the seam of prior art imaging member belts prepared from the webstock of Comparative Example 1. The result seen for fatigue belt flexing induced the charge transport layer cracking due to constant dynamic bending over machine belt support module rollers was even more encouraging, because charge transport layer cracking was notably extended by a factor of 4 for the belts fabricated with the imaging member web stocks of Invention Examples VI and VII over the control belt counterpart prepared from web stock of prior art Comparative Example 1.

The results for seam splashing size reduction, effectual fatigue seam cracking/delimination failure suppression, and charge transport layer cracking life extension for the belt prepared using the invention imaging member web stocks were the all achieved through thermal contraction matching of the charge transport layer with the substrate support layer, permanently eliminating the internal strain on the charge transport layer and providing a curl-free imaging member webstock eliminating the need of an anticurl backing layer, as described herein.

The selection and utilization of a substrate support layer such as KAPTON KJ or IMIDEX to eliminate the need of anticurl backing layer was found not to alter the delicate photo-electrical function of the imaging members nor causing significant affect on seam rupture strength reduction of the fabricated flexible imaging member belts.

Although the invention has been described with reference to specific embodiments, it is not intended to be limited thereto, rather those having ordinary skill in the art will recognize that variations and modifications may be made therein which are within the spirit of the invention and within the scope of the claims.

What is claimed is:

1. An imaging member comprising a substrate support layer;

an electrically conductive substrate surface layer;

a hole blocking layer;

an optional adhesive layer;

a charge generating layer;

and a charge transport layer with a thermal contraction coefficient value substantially equal to that of the substrate support layer and wherein said substrate layer comprises (I)

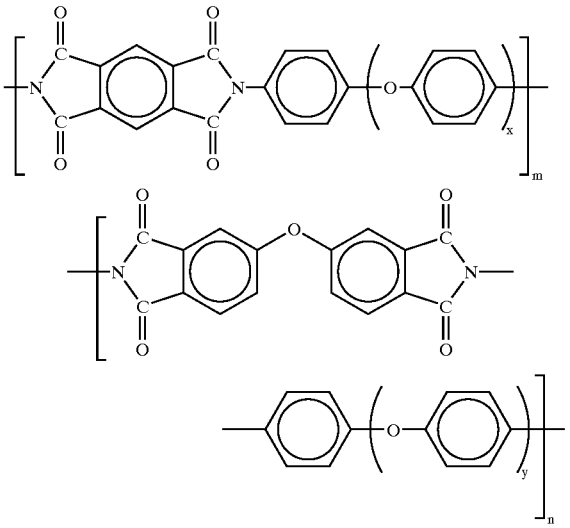

wherein m and n represent the degree of polymerization, optionally being a number from about 50 to about 125, and x and y represent the number of segments, x and y optionally being from about 3 to about 7.

2. An imaging member according to claim 1 wherein the substrate support layer and the charge transport layer have a thermal contraction coefficient difference of about $-2\times10^{-5}/°$ C. to about $+2\times10^{-5}/°$ C.

3. An imaging member according to claim 1 wherein the substrate support layer and the charge transport layer have a thermal contraction coefficient difference about $-1\times10^{-5}/°$ C. to about $+1\times10^{-5}/°$ C.

4. An imaging member according to claim 1 wherein the substrate support layer and the charge transport layer possess a thermal contraction coefficient difference about $1\times10^{-5\times10-5}/°$ C. to about $+0.5\times10^{-5}/°$ C.

5. An imaging member according to claim 1 wherein the substrate support layer possesses a Glass Transition Temperature (Tg) of at least about 100° C.

6. An imaging member according to claim 1 wherein the substrate support layer possess a Glass Transition Temperature (Tg) of from about 100° C. to about 300° C.

7. An imaging member according to claim 1 wherein the substrate support layer is resistant to attack by solvents selected for the charge transport layer coating solution.

8. An imaging member according to claim 1 wherein the substrate support layer is flexible and connected into a flexible imaging member belt by welding, gluing, taping, stapling, or pressure heat fusing.

9. An imaging member according to claim 1 wherein the substrate support layer is connected into a flexible imaging member belt by a welding process.

10. An imaging member according to claim 1 wherein the substrate support layer is welded into a flexible imaging member belt by an ultrasonic seam welding process.

11. An imaging member according to claim 1 wherein the substrate support layer has a thickness of from about 25 micrometers to about 200 micrometers.

12. An imaging member according to claim 1 wherein the substrate support layer has a thickness of from about 50 micrometers to about 125 micrometers.

13. An imaging member according to claim 1 wherein the electrically conductive surface layer comprises aluminum, titanium, zirconium, nickel, chromium, copper, brass, stainless steel, silver, carbon black, or graphite.

14. An imaging member according to claim 13 wherein the surface layer comprises aluminum.

15. An imaging member according to claim 13 wherein the surface layer comprises titanium.

16. An imaging member according to claim 13 wherein the surface layer comprises zirconium.

17. An imaging member according to claim 1 wherein the electrically conductive surface layer has a thickness of from about 20 Angstroms to about 750 Angstroms.

18. An imaging member according to claim 1 wherein the electrically conductive surface layer has a light energy transmission of at least, about 15% transmittancy.

19. An imaging member according to claim 1 wherein the electrically conductive surface layer has a light energy transmission of at least 20% transmittancy.

20. An imaging member according to claim 1 wherein the electrically conductive surface layer has a thickness of from about 50 Angstroms to about 120 Angstroms.

21. An imaging member according to claim 1 wherein the hole blocking layer has a thickness of equal to or less than about 0.2 micrometers.

22. An imaging member according to claim 1 wherein the adhesive layer has a thickness layer has a thickness of from about 0.05 micrometers to about 0.3 micrometers.

23. An imaging member according to claim 1 wherein the substrate support layer is a thermoplastic polyimide.

24. An imaging member according to claim 1 wherein the substrate support layer material is represented by the formula:

(I)

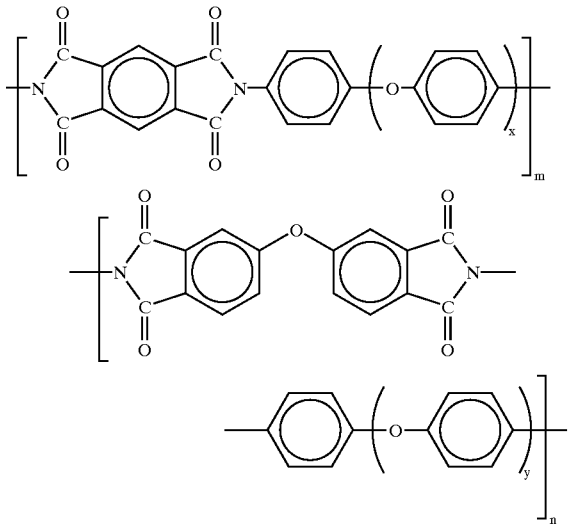

wherein m and n represent the degree of polymerization, for example numbered from about 50 to about 125, and x and y represent the number of segments, for example, from about 3 to about 7.

25. An imaging member in accordance with claim 1 wherein said photogenerating layer is comprised of photogenerating pigments.

26. An imaging member in accordance with claim 1 wherein said photogenerating layer is comprised of photogenerating pigments and wherein said pigments are comprised of selenium, selenium alloys, metal free phthalocyanine, metal phthalocyanine, or trigonal selenium.

27. An imaging member in accordance with claim 1 wherein said photogenerating layer is comprised of trigonal selenium and said charge transport layer is comprised of charge transport molecules of N,N'-diphenyl-N,N'-bis(3-methylphenyl)-1,1'-biphenyl-4,4'-diamine.

28. An imaging member in accordance with claim 1 wherein X is 2, Y is 2 and wherein said polyimide possess a thermal contraction coefficient of $6.5\times10^{-5}$/° C.

29. An imaging member comprising a support layer;

an electrically conductive substrate surface layer;

a hole blocking layer;

an optional adhesive layer;

a charge generating layer;

and a charge transport layer with a thermal contraction coefficient value substantially equal to that of the support layer and wherein the substrate support layer comprises:

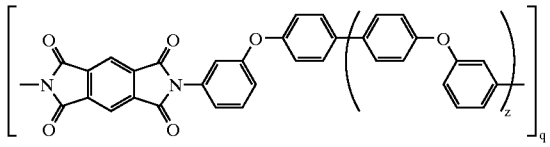

wherein q represents the degree of polymerization and further wherein the charge transport layer is comprised of charge transport molecules.

30. An imaging member in accordance with claim 29 wherein said charge transport layer is comprised of aryl amine hole transport molecules.

31. An imaging member in accordance with claim 30 wherein said molecules are selected from the group consisting of triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine and N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine.

32. An imaging member in accordance with claim 30 wherein said charge transport layer contains a polymeric binder.

33. An imaging member in accordance with claim 32 wherein said polymeric binder is comprised of polycarbonates, polyesters, polyimides, polyurethanes or polystyrenes.

* * * * *